US009435221B2

(12) United States Patent
Smith

(10) Patent No.: US 9,435,221 B2
(45) Date of Patent: Sep. 6, 2016

(54) TURBOMACHINE AIRFOIL POSITIONING

(71) Applicant: General Electric Company, Schenectady, NY (US)

(72) Inventor: Paul Kendall Smith, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 396 days.

(21) Appl. No.: 13/963,689

(22) Filed: Aug. 9, 2013

(65) Prior Publication Data

US 2015/0044017 A1 Feb. 12, 2015

(51) Int. Cl.

*F01D 21/00* (2006.01)
*F01D 5/14* (2006.01)
*F01D 9/02* (2006.01)

(52) U.S. Cl.

CPC ..... *F01D 21/003* (2013.01); *F01D 5/142* (2013.01); *F01D 5/143* (2013.01); *F01D 5/145* (2013.01); *F01D 5/146* (2013.01); *F01D 9/02* (2013.01)

(58) Field of Classification Search

CPC ..... F01D 21/003; F01D 5/146; F01D 5/145; F01D 5/143; F01D 5/142; F01D 9/02
USPC ..... 415/193.1, 209.1, 193
See application file for complete search history.

(56) References Cited

U.S. PATENT DOCUMENTS 2,663,493 A 12/1953 Keast
3,347,520 A 10/1967 Dweczarek
3,572,962 A 3/1971 Embleton et al.
3,643,426 A 2/1972 Janelid
3,734,639 A 5/1973 Short
3,745,629 A 7/1973 Pask et al.
4,259,842 A 4/1981 Koshoffer et al.

(Continued)

FOREIGN PATENT DOCUMENTS

CN 1955440 A 5/2007
CN 101050722 A 10/2007

(Continued)

OTHER PUBLICATIONS

Chinese Office Action issued in connection with corresponding CN Application No. 201310408334.8 on Oct. 30, 2015, 14 pages.

(Continued)

*Primary Examiner* — Hoang Nguyen
(74) *Attorney, Agent, or Firm* — Ernest G. Cusick; Hoffman Warnick LLC

(57) ABSTRACT

Embodiments of the invention relate generally to turbomachines and, more particularly, to the positioning of airfoils to reduce pressure variations entering a diffuser. One embodiment includes a turbomachine comprising a diffuser, a plurality of airfoil rows, including a first airfoil row adjacent the diffuser, the first airfoil row being of a first type selected from a group consisting of stationary vanes and rotating blades, a second airfoil row adjacent the first airfoil row, the second airfoil row being of a second type different from the first type, and a third airfoil row of the first type adjacent the second airfoil row, wherein at least one of the plurality of airfoil rows is clocked, relative to another airfoil row of the turbomachine, reducing variations in airflow circumferential pressure at at least one spanwise location in the diffuser adjacent the first airfoil row in an operative state of the turbomachine.

18 Claims, 4 Drawing Sheets

(56) References Cited

U.S. PATENT DOCUMENTS

| | | | | |
|---|---|---|---|---|
| 4,284,388 | A | 8/1981 | Szewalski | |
| 4,504,189 | A | 3/1985 | Lings | |
| 4,585,395 | A | 4/1986 | Nourse et al. | |
| 4,616,975 | A | 10/1986 | Duncan | |
| 4,619,580 | A | 10/1986 | Snyder | |
| 4,714,407 | A | 12/1987 | Cox et al. | |
| 4,786,016 | A | 11/1988 | Presz et al. | |
| 4,802,821 | A | 2/1989 | Krietmeier | |
| 4,809,498 | A | 3/1989 | Giffin et al. | |
| 4,844,689 | A | 7/1989 | Seed | |
| 4,896,510 | A | 1/1990 | Foltz | |
| 4,968,216 | A | 11/1990 | Anderson et al. | |
| 5,226,278 | A | 7/1993 | Meylan et al. | |
| 5,249,922 | A | 10/1993 | Sato et al. | |
| 5,274,991 | A | 1/1994 | Fitts | |
| 5,342,170 | A | 8/1994 | Elvekjaer et al. | |
| 5,406,786 | A | 4/1995 | Scharpf et al. | |
| 5,486,091 | A | 1/1996 | Sharma | |
| 5,749,218 | A | 5/1998 | Cromer et al. | |
| 5,785,498 | A | 7/1998 | Quinn et al. | |
| 5,813,828 | A | 9/1998 | Norris | |
| 6,174,129 | B1 | 1/2001 | Mazzola et al. | |
| 6,209,325 | B1 | 4/2001 | Alkabie | |
| 6,345,493 | B1 | 2/2002 | Smith et al. | |
| 6,402,458 | B1 * | 6/2002 | Turner | F01D 5/142 415/1 |
| 6,409,126 | B1 | 6/2002 | Cunningham, Jr. | |
| 6,428,281 | B1 | 8/2002 | Botrel | |
| 6,435,814 | B1 | 8/2002 | Yu et al. | |
| 6,438,961 | B2 | 8/2002 | Tuthill et al. | |
| 6,442,941 | B1 | 9/2002 | Anand et al. | |
| 6,446,438 | B1 | 9/2002 | Kraft et al. | |
| 6,484,505 | B1 | 11/2002 | Brown et al. | |
| 6,491,493 | B1 | 12/2002 | Watanabe et al. | |
| 6,527,503 | B2 | 3/2003 | Spano et al. | |
| 6,540,478 | B2 | 4/2003 | Fiala et al. | |
| 6,543,234 | B2 | 4/2003 | Anand et al. | |
| 6,554,562 | B2 | 4/2003 | Dudebout et al. | |
| 6,584,779 | B2 | 7/2003 | Priestley | |
| 6,598,398 | B2 | 7/2003 | Viteri et al. | |
| 6,602,458 | B1 | 8/2003 | Skov | |
| 6,626,635 | B1 | 9/2003 | Prowse et al. | |
| 6,772,595 | B2 | 8/2004 | Martling et al. | |
| 6,824,710 | B2 | 11/2004 | Viteri et al. | |
| 6,887,042 | B2 | 5/2005 | Ito et al. | |
| 6,899,081 | B2 | 5/2005 | Bielicki et al. | |
| 6,905,307 | B2 | 6/2005 | Kawarada et al. | |
| 6,910,335 | B2 | 6/2005 | Viteri et al. | |
| 6,913,441 | B2 | 7/2005 | Fadok | |
| 6,935,116 | B2 | 8/2005 | Stuttaford et al. | |
| 6,958,383 | B2 | 10/2005 | Desmazeau et al. | |
| D511,377 | S | 11/2005 | Erwan et al. | |
| 6,986,639 | B2 | 1/2006 | Teramura et al. | |
| 7,007,478 | B2 | 3/2006 | Dinu | |
| 7,089,742 | B2 | 8/2006 | Spooner et al. | |
| 7,121,792 | B1 | 10/2006 | Fessou et al. | |
| 7,217,101 | B2 | 5/2007 | Harvey | |
| 7,340,129 | B2 | 3/2008 | Yalin et al. | |
| 7,373,773 | B2 | 5/2008 | Noda | |
| 7,410,343 | B2 | 8/2008 | Wakazono et al. | |
| 7,412,129 | B2 | 8/2008 | Yalin et al. | |
| 7,420,662 | B2 | 9/2008 | Yalin et al. | |
| 7,574,865 | B2 | 8/2009 | Bland | |
| 7,654,320 | B2 | 2/2010 | Payton | |
| 7,758,297 | B2 | 7/2010 | Fiala | |
| 7,758,306 | B2 | 7/2010 | Burton et al. | |
| 7,762,074 | B2 | 7/2010 | Bland et al. | |
| 7,805,946 | B2 | 10/2010 | Ohri et al. | |
| 7,896,645 | B2 | 3/2011 | Loving | |
| 8,083,476 | B2 | 12/2011 | Guimbard et al. | |
| 8,234,872 | B2 | 8/2012 | Berry et al. | |
| 8,286,347 | B2 | 10/2012 | Dupeux et al. | |
| 8,297,919 | B2 * | 10/2012 | Ning | F01D 1/04 415/193 |
| 8,307,657 | B2 | 11/2012 | Chila | |
| 8,308,112 | B2 | 11/2012 | Post et al. | |
| 8,425,185 | B2 | 4/2013 | Myoren et al. | |
| 8,516,822 | B2 | 8/2013 | Chen et al. | |
| 8,540,490 | B2 | 9/2013 | Ramakrishnan et al. | |
| 8,707,672 | B2 | 4/2014 | Zuo et al. | |
| 2002/0048510 | A1 | 4/2002 | Spano et al. | |
| 2002/0124572 | A1 | 9/2002 | Pidcock et al. | |
| 2003/0136102 | A1 | 7/2003 | Nottin | |
| 2005/0172607 | A1 | 8/2005 | Ishizaka et al. | |
| 2005/0206196 | A1 | 9/2005 | Ortega et al. | |
| 2006/0101801 | A1 | 5/2006 | Bland | |
| 2006/0283189 | A1 | 12/2006 | Lipinski et al. | |
| 2007/0025836 | A1 | 2/2007 | Nichols et al. | |
| 2007/0130958 | A1 | 6/2007 | Ohri et al. | |
| 2007/0251240 | A1 | 11/2007 | Johnson et al. | |
| 2009/0155062 | A1 | 6/2009 | Guimbard et al. | |
| 2009/0223228 | A1 | 9/2009 | Romoser | |
| 2009/0320484 | A1 | 12/2009 | Lacy et al. | |
| 2010/0054922 | A1 * | 3/2010 | Ning | F01D 5/142 415/129 |
| 2010/0054929 | A1 * | 3/2010 | Ning | F01D 5/142 415/189 |
| 2010/0111684 | A1 | 5/2010 | Ning et al. | |
| 2010/0122538 | A1 | 5/2010 | Ning et al. | |
| 2010/0287943 | A1 | 11/2010 | McMahan et al. | |
| 2010/0326082 | A1 | 12/2010 | Ziminsky et al. | |
| 2011/0107766 | A1 | 5/2011 | Davis, Jr. et al. | |
| 2011/0189003 | A1 | 8/2011 | Iida | |
| 2011/0197586 | A1 | 8/2011 | Berry et al. | |
| 2011/0214429 | A1 | 9/2011 | Chen et al. | |
| 2012/0051894 | A1 | 3/2012 | Clements et al. | |
| 2012/0085100 | A1 | 4/2012 | Hughes et al. | |
| 2012/0159954 | A1 | 6/2012 | Ito et al. | |
| 2012/0167586 | A1 | 7/2012 | Bailey et al. | |
| 2012/0186255 | A1 | 7/2012 | Parsania et al. | |
| 2012/0247118 | A1 | 10/2012 | Antoniono et al. | |
| 2012/0297785 | A1 | 11/2012 | Melton et al. | |
| 2013/0115566 | A1 | 5/2013 | Khan et al. | |
| 2014/0020395 | A1 | 1/2014 | Smith et al. | |
| 2014/0041357 | A1 | 2/2014 | Malandra et al. | |
| 2014/0072433 | A1 | 3/2014 | Holloway | |

FOREIGN PATENT DOCUMENTS

| | | | |
|---|---|---|---|
| CN | 101173673 | A | 5/2008 |
| CN | 101296842 | A | 10/2008 |
| EP | 1130321 | A1 | 9/2001 |
| EP | 1247938 | A2 | 10/2002 |
| EP | 1482246 | A1 | 12/2004 |
| EP | 2154431 | A2 | 2/2010 |
| JP | 54-114619 | A | 9/1979 |
| JP | 54114618 | A | 9/1979 |

OTHER PUBLICATIONS

Extended European Search Report for EP Application No. 12190915.4-1602, dated Feb. 11, 2013, 7 pages.

Extended European Search Report for EP Application No. 12190923.8-1602, dated Feb. 13, 2013, 6 pages.

Office Action for CN Application No. 20120369382.6, dated Feb. 25, 2015, 11 pages.

* cited by examiner

TURBOMACHINE AIRFOIL POSITIONING

BACKGROUND OF THE INVENTION

Turbomachines, such as turbines, engines, and compressors, include pluralities of stationary vanes and rotating blades. These are typically arranged in alternating stacked airfoil rows disposed around and along the longitudinal axis of the machine, with the vanes affixed to the turbine casing and the blades affixed to a disk connected to a shaft. Efforts have been made to improve the efficiency of such machines by indexing or "clocking" the relative circumferential positions of airfoils in one row to the circumferential positions of airfoils in adjacent or nearby rows. Typically, such improvement is achieved by reducing the impact of vane wake on the rotating blades.

Some turbomachines, such as gas turbines, include a diffuser disposed adjacent the final stage of the turbine. Such a diffuser is configured to decelerate the exhaust flow, converting dynamic energy to a static pressure rise, and do so more efficiently when circumferential variation in the flow entering the diffuser is reduced. Known turbomachines and clocking methods do not address or consider the circumferential variation of the flow field entering the diffuser. In fact, some clocking methods may increase circumferential variation in order to provide efficiencies in other areas of the turbine, such as increased energy efficiency or decreased vibration and stress in the airfoils.

BRIEF DESCRIPTION OF THE INVENTION

Embodiments of the invention relate generally to turbomachines and, more particularly, to the clocking of turbomachine airfoils to reduce airflow pressure variations entering a diffuser of the turbomachine.

In one embodiment, the invention provides a turbomachine comprising: a diffuser; a plurality of airfoil rows, including: a first airfoil row adjacent the diffuser, the first airfoil row being of a first type selected from a group consisting of: stationary vanes and rotating blades; a second airfoil row adjacent the first airfoil row, the second airfoil row being of a second type different from the first type; and a third airfoil row of the first type adjacent the second airfoil row, wherein at least one of the plurality of airfoil rows is clocked, relative to another airfoil row of the turbomachine, reducing variations in airflow circumferential pressure at at least one spanwise location in the diffuser adjacent the first airfoil row in an operative state of the turbomachine.

In another embodiment, the invention provides a method of reducing variation in airflow pressure entering a diffuser of a turbomachine, the method comprising: calculating airflow across at least three airfoil rows of the turbomachine, the at least three airfoil rows including: a first airfoil row adjacent a diffuser of the turbomachine, the first airfoil row being of a first type selected from a group consisting of: stationary vanes and rotating blades; a second airfoil row adjacent the first airfoil row, the second airfoil row being of a second type different from the first type; and a third airfoil row of the first type adjacent the second airfoil row; evaluating a pressure variation at at least one spanwise location of the diffuser; and determining whether the pressure variation is within a predetermined target.

In still another embodiment, the invention provides a method of reducing variation in airflow pressure entering a diffuser of a turbomachine, the method comprising: calculating airflow across at least airfoil rows of the turbomachine; evaluating a first pressure variation at at least one spanwise location of a diffuser of the turbomachine; changing a relative clocking position of at least one of the three airfoil rows; recalculating airflow across the at least three airfoil rows; evaluating a second pressure variation at the at least one spanwise location of the diffuser; determining whether the second pressure variation is less than the first pressure variation; and in the case that the second pressure variation is less than the first pressure variation, operating the turbomachine using the changed relative clocking position of the at least one airfoil row.

BRIEF DESCRIPTION OF THE DRAWINGS

These and other features of embodiments of the invention will be more readily understood from the following detailed description of the various aspects of the invention taken in conjunction with the accompanying drawings that depict various embodiments of the invention, in which.

It is noted that the drawings are not to scale and are intended to depict only typical aspects of the invention. The drawings should not, therefore, be considered as limiting the scope of the invention. In the drawings, like numbering represents like elements among the drawings.

DETAILED DESCRIPTION OF THE INVENTION

Figure 1:
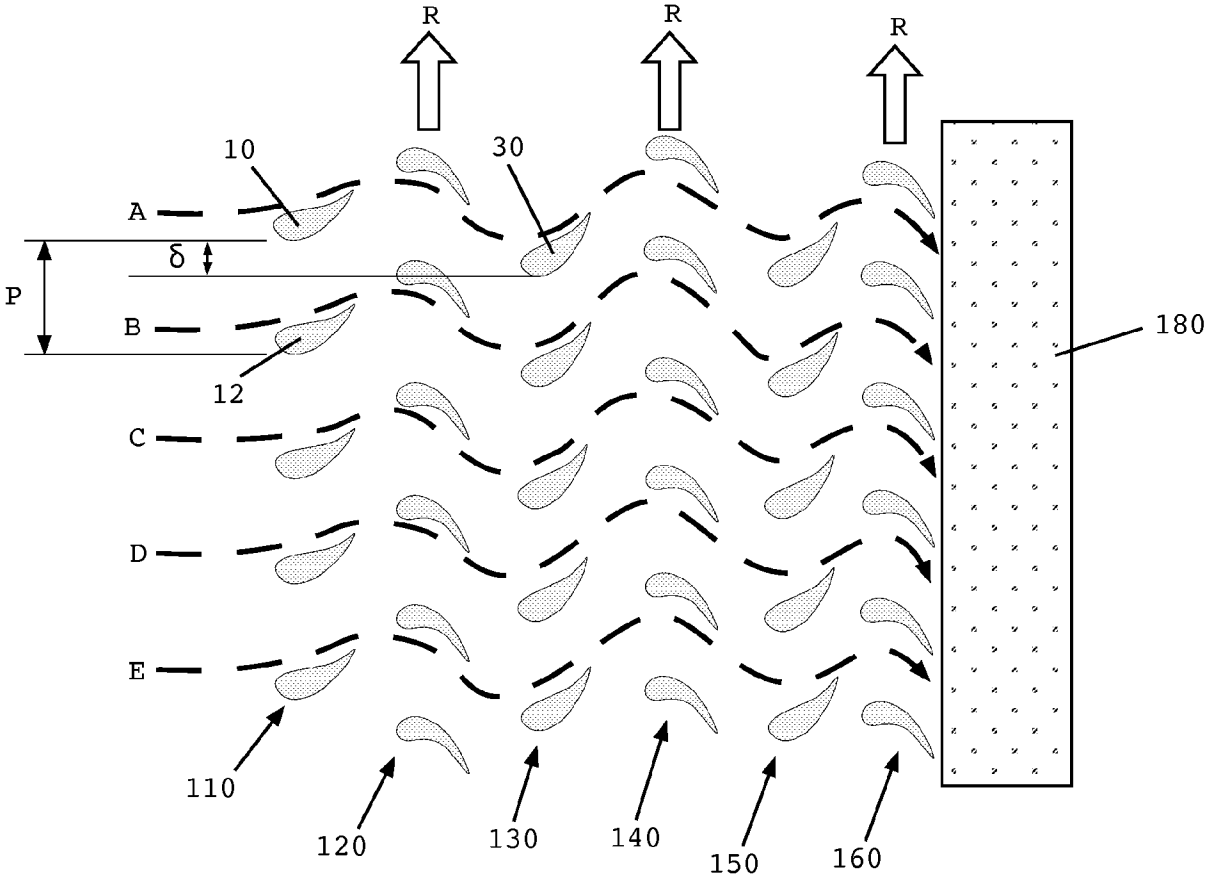
FIG. 1 shows a schematic view of airfoils and a diffuser of a turbomachine.

FIG. 1 is a schematic representation of neighboring rows 110, 120, 130, 140, 150, 160 of airfoils as may be found, for example, in a gas turbine. Row 160 is the last (i.e., most downstream or terminal) airfoil row of a turbine and sits adjacent a diffuser 180. Rows 110, 130, and 150 show stationary vanes. Rows 120, 140, and 160 show blades that, in operation, rotate in direction R. As one of ordinary skill in the art will appreciate, in other embodiments of the invention, rows 110, 130, and 150 may comprise blades and rows 120, 140, and 160 may comprise vanes.

Similarly, one skilled in the art will appreciate that rows 110, 120, 130, 140, 150, and 160, which will be referred to below as a first, second, third, fourth, fifth, and sixth row, respectively, are intended to describe relative ordering of the rows. That is, a turbine or other turbomachine according to various embodiments of the invention may include more than the six airfoil rows shown in FIG. 1 and methods according to various embodiments of the invention are applicable to turbomachines having more or fewer than six airfoil rows. As will be described below in greater detail, methods according to embodiments of the invention are applicable to turbines or other turbomachines having a diffuser and three or more rows of airfoils.

The airfoils and their shapes shown in FIG. 1 are merely illustrative and should not be viewed as limiting the scope of the invention. Methods according to embodiments of the invention, as well as turbomachines constructed or configured according to embodiments of the invention, may include airfoils of any number, shape, and size.

The pitch of the airfoils may be described as the circumferential distance between corresponding features of adjacent airfoils of the same row. For example, as shown in FIG. 1, pitch P is the distance between the high curvature point of vane 10 and vane 12. Other features may be used to define pitch P, of course. For example, pitch P may be measured from leading edge to leading edge of adjacent vanes, which would yield the same distance in a cylindrical flow path as that from trailing edge to trailing edge.

As can be seen in FIG. 1, first row 110 is clocked with respect to row 130, with vane 30 offset from vane 10 by distance δ. Distance δ may be expressed, for example, as a function—e.g., 0.1, 0.2, 0.3, etc.—of pitch P. As shown in FIG. 1, distance δ may be, for example, 0.3 of pitch P.

One of ordinary skill in the art will appreciate that clocked airfoil rows will generally have substantially the same pitch, but with an airfoil in one row offset in position from a corresponding airfoil in the row with respect to which it is clocked. FIG. 1 also shows a plurality of fluid flows A, B, C, D, and E through rows 110, 120, 130, 140, 150, and 160 to diffuser 180.

Figure 2:
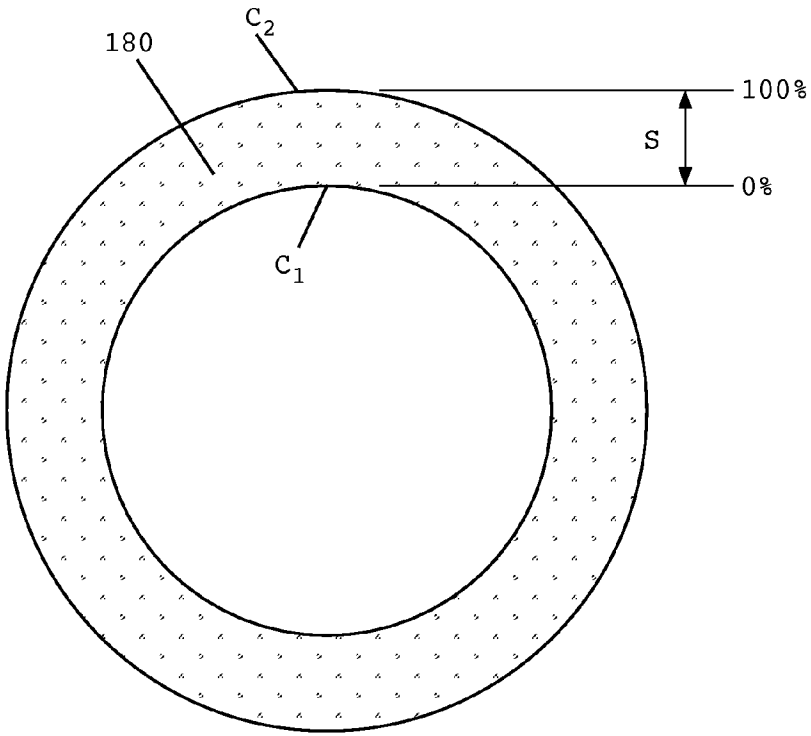
FIG. 2 shows a schematic view of a cross-sectional shape of a diffuser at a position adjacent an airfoil row nearest the diffuser.

FIG. 2 is a schematic representation of a cross-section of diffuser 180 adjacent fourth row 140 (FIG. 1). Fluid flows enter diffuser 180 across span S, extending from an inner circumference $C_1$—0% span—to an outer circumference $C_2$—100% span. Circumferential variations in pressure flow into diffuser 180 decrease overall machine efficiency.

Figure 3:
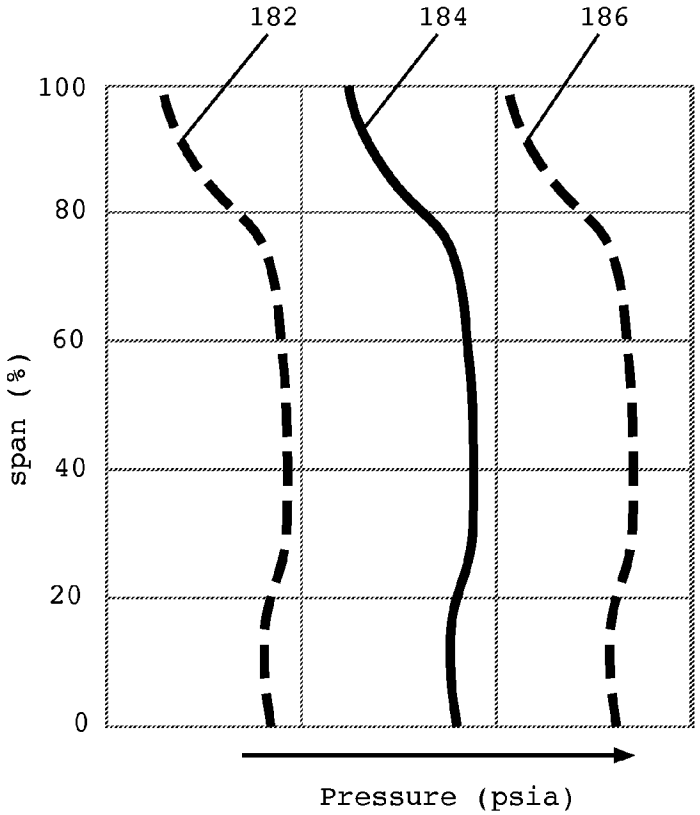
FIG. 3 is a graphical representation of pressures measured across the radial span of a diffuser.

FIG. 3 shows a graph of pressures measured across the span of a diffuser of a typical turbine. Minimum pressures 182 measured from 0% span to 100% span are significantly less than maximum pressures 186. Average pressures 184 are, as expected, intermediate minimum pressures 182 and maximum pressures 186. Any steps taken to reduce the difference between minimum pressures 182 and maximum pressures 186 will improve the efficiencies of both the diffuser and the turbomachine overall.

While known clocking techniques have been employed to address other causes of inefficiency or strain, such as the impact of vane wake on rotating blades, such techniques generally have focused on "upstream" airfoil rows located furthest from the diffuser. Applicants have found that the clocking of late stage airfoils—those nearer the diffuser—can significantly reduce the variation in the flow field entering the diffuser, thereby improving diffuser performance and aerodynamic robustness. In some embodiments of the invention, the clocking of such late stage airfoils includes clocking at least two of three adjacent airfoil rows nearest the diffuser.

For example, referring again to FIG. 1, in one embodiment of the invention, third and fifth rows 130, 150 may be clocked with respect to each other. In another embodiment of the invention, second and fourth rows 120, 140 may also be clocked with respect to each other. One skilled in the art will appreciate that the clocking of airfoil rows may be carried out with respect to pairs or groups of stationary vane rows as well as with respect to pairs or groups of rotating blade rows.

Figure 4:
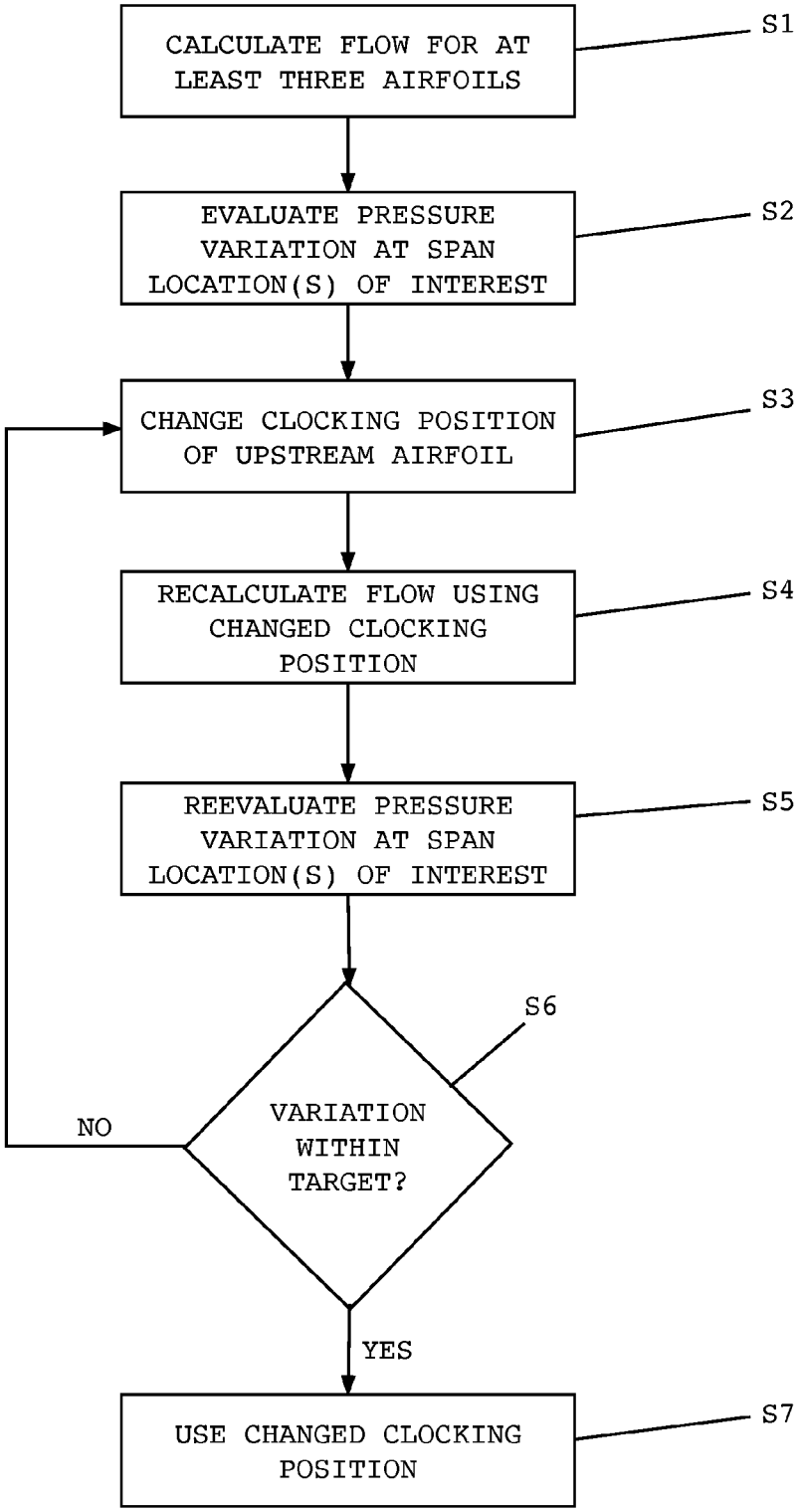
FIG. 4 shows a flow diagram of a method according to an embodiment of the invention.

FIG. 4 shows a flow diagram of a method of clocking airfoils to reduce variation in diffuser inflow according to an embodiment of the invention. At S1, airflows across at least three airfoil rows nearest the diffuser are calculated. As noted above, the at least three airfoil rows may include a pair of stationary vane rows and an intervening rotating blade row or a pair of rotating blade rows and an intervening stationary vane row. For example, referring again to FIG. 1, the at least three airfoil rows across which airflow would be calculated at S1 include rows 140, 150, and 160.

The calculation of airflows across turbomachine airfoils typically relies upon computational fluid dynamics (CFD) to model turbulence. In some embodiments of the invention, this may include employing the Navier-Stokes or Reynolds-averaged Navier-Stokes solver equations—the basic governing equations for viscous, heat conducting fluids. Other solver equations may also be employed for any number of reasons, as will be appreciated by one skilled in the art.

The Navier-Stokes solver equations are a set of differential equations, including a continuity equation for the conservation of mass, conservation of momentum equations, and a conservation of energy equation. These equations employ spatial and temporal variables, as well as pressure, temperature, and density variables. One skilled in the art will recognize, of course, that other CFD equations and techniques may be used. Specifically, it should be noted that other solver equations may be employed and the use of other CFD equations, techniques, or solver equations is intended to be within the scope of the invention.

Returning to FIG. 4, at S2, using the flows calculated at S1, pressure variation at the diffuser is evaluated at one or more span locations of interest. In some embodiments, pressure variations may be evaluated at representative locations across the entire span of the diffuser, from 0% span (at its inner circumference—$C_1$ in FIG. 2) to 100% span (at its outer circumference—$C_2$ in FIG. 2). In other embodiments, pressure variation may be evaluated at a single location, e.g., at 0% span.

As will be discussed below, one skilled in the art will recognize that, typically, pressure variation at the diffuser will not be eliminated entirely. As such, there will generally be some level of pressure variation at the diffuser that will be acceptable for a particular turbomachine. This may be, for example, a percentage deviation from an average pressure. Clocking airfoils according to embodiments of the invention will therefore typically seek to reduce pressure variation to a point equal to or less than such a targeted pressure variation.

At S3, the relative clocking position of at least one upstream row of airfoils of similar type is changed (e.g., where the airfoil row adjacent the diffuser is a blade row, the relative clocking position of an upstream row of blades is changed). For example, returning to FIG. 1, changing the clocking at S3 may include changing the clocking of the blade of row 140 relative to the blades of row 160 as a function of pitch P.

In other embodiments of the invention, changing the clocking at S3 may include changing the clocking of row 130 relative to row 150. One skilled in the art will recognize that other changes to the relative positions of upstream rows of airfoils in carrying out S3.

In any case, flow is recalculated at S4 using the changed clocking position and the pressure variation is reevaluated at S5.

At S6, it is determined whether the pressure variation at S5 is within a targeted pressure variation (e.g., 5% of the average pressure measured). If so (i.e., YES at S6), the changed clocking positions may be used in operation of the turbomachine at S7. If not (i.e., NO at S6), S3 through S6 may be iteratively looped until the pressure variation at S5 is found to be within the targeted pressure variation at S6.

The targeted pressure variation at S6 may be an absolute value (e.g., an amount of variation in p.s.i.), an amount of decrease in pressure variation (e.g., a decrease of 1%, 2%, 3%, etc.) with respect to the pressure variation at S2, or any pressure variation value less than the pressure variation at S2.

Figure 5:
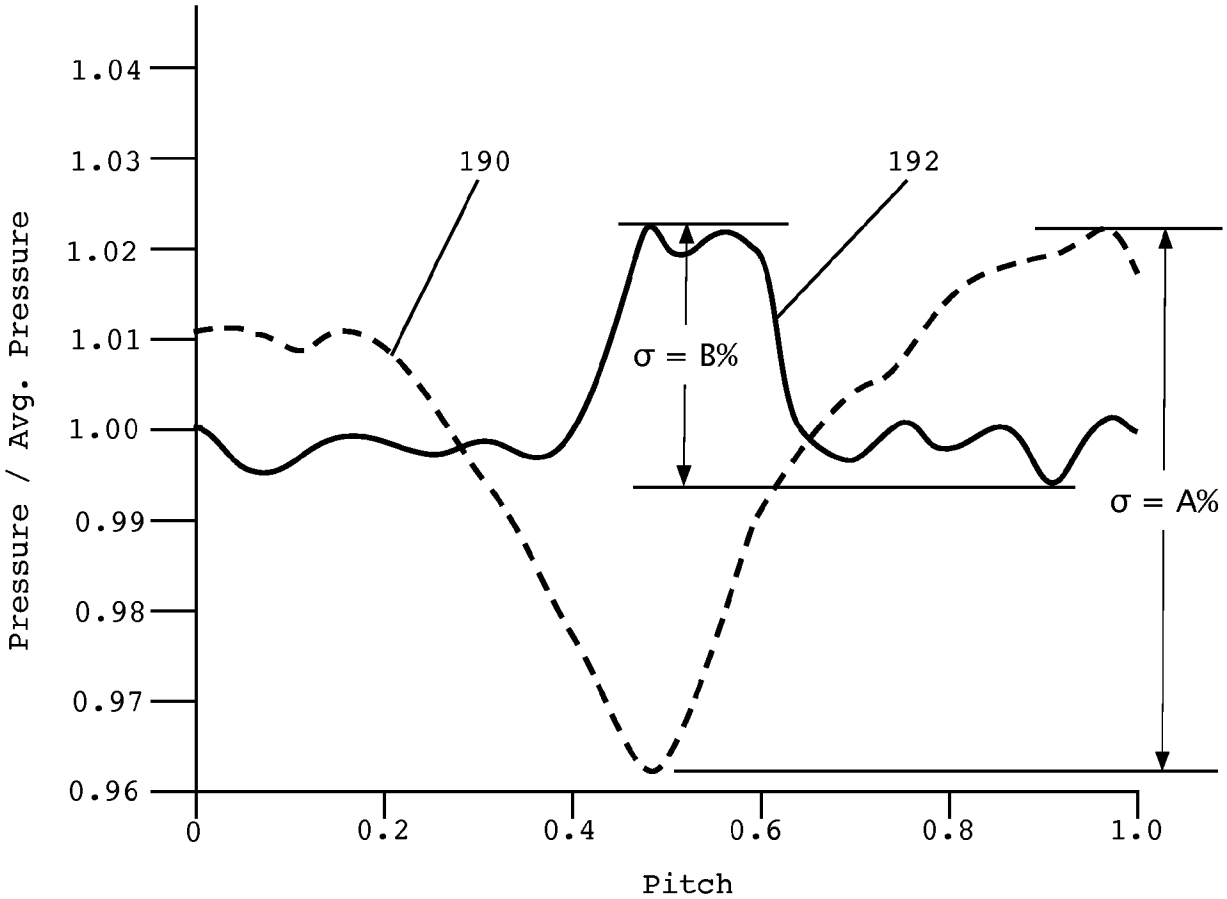
FIG. 5 is a graphical representation of pressure variations at a surface of a diffuser before and after airfoil clocking according to an embodiment of the invention.

FIG. 5 shows a graphical comparison of pressure variation (measured pressure/average pressure) as a function of clocking position (pitch) before 190 and after 192 clocking according to an embodiment of the invention. Before 190 and after 192 clocking should be understood to mean before and after clocking according to an embodiment of the invention, not necessarily before and after any clocking of the airfoils of the turbomachine. That is, embodiments of the invention may be employed to clock airfoils in rows nearest a diffuser 180 after the airfoils of the turbomachine have otherwise been clocked for purposes other than reducing variation in airflow at the diffuser. As noted above, such other purposes often involve the clocking of "upstream" airfoil rows furthest from the diffuser. As such, clocking methods according to embodiments of the invention may be employed in combination with other clocking methods known in the art.

Returning to FIG. 5, as can be seen, before clocking, pressure variation was calculated to be A %, but was reduced to approximately B % by employing a clocking method according to an embodiment of the invention.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any related or incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A turbomachine comprising:

a diffuser;

a plurality of airfoil rows, including:

a first airfoil row adjacent the diffuser, the first airfoil row being of a first type selected from a group consisting of: stationary vanes and rotating blades;

a second airfoil row adjacent the first airfoil row, the second airfoil row being of a second type different from the first type; and a third airfoil row of the first type adjacent the second airfoil row, wherein at least one of the plurality of airfoil rows is clocked, relative to another airfoil row of the turbomachine, reducing variations in airflow circumferential pressure at at least one spanwise location in the diffuser adjacent the first airfoil row in an operative state of the turbomachine.

2. The turbomachine of claim 1, selected from a group consisting of: a turbine, an engine, and a compressor.

3. The turbomachine of claim 2, wherein the turbomachine is a gas turbine.

4. The turbomachine of claim 1, wherein the at least one of the plurality of airfoil rows is clocked to a first relative position that exhibits a first variation in airflow pressure at the at least one point on the surface of the diffuser that is less than a second variation in airflow pressure at the at least one point in the diffuser exhibited at a second relative position.

5. The turbomachine of claim 4, wherein the first and second variations are calculated using the relative positions of the at least one airfoil row and another airfoil row of the turbomachine.

6. The turbomachine of claim 5, wherein the first and second variations are calculated using computational fluid dynamics equations.

7. The turbomachine of claim 6, wherein the computational fluid dynamics equations include Navier-Stokes equations.

8. The turbomachine of claim 1, wherein the at least one of the plurality of airfoil rows clocked includes the third airfoil row.

9. The turbomachine of claim 8, wherein the first and third airfoil rows are rows of rotating blades and the second airfoil row is a row of stationary vanes.

10. A method of reducing variation in airflow pressure entering a diffuser of a turbomachine, the method comprising:

while operating the turbomachine, calculating airflow across at least three airfoil rows of the turbomachine, the at least three airfoil rows including:

a first airfoil row adjacent a diffuser of the turbomachine, the first airfoil row being of a first type selected from a group consisting of: stationary vanes and rotating blades;

a second airfoil row adjacent the first airfoil row, the second airfoil row being of a second type different from the first type; and a third airfoil row of the first type adjacent the second airfoil row;

evaluating a pressure variation at at least one spanwise location of the diffuser; and determining whether the pressure variation is within a predetermined target, wherein, in the case that the pressure variation is not within the predetermined target, the method further includes:

changing a relative clocking position of at least one of the at least three airfoil rows;

recalculating airflow across the at least three airfoil rows;

reevaluating the pressure variation at the at least one spanwise location of the diffuser; and determining whether the reevaluated pressure variation is within the predetermined target.

11. The method of claim 10, wherein changing the relative clocking position includes changing the clocking position of an airfoil row other than the first, second, or third airfoil rows.

12. The method of claim 10, wherein calculating the airflow includes the use of computational fluid dynamics equations.

13. The method of claim 12, wherein the computational fluid dynamics equations include Navier-Stokes solver equations.

14. A method of reducing variation in airflow pressure entering a diffuser of a turbomachine, the method comprising:

while operating the turbomachine, calculating airflow across at least three airfoil rows of the turbomachine;

evaluating a first pressure variation at at least one spanwise location of a diffuser of the turbomachine;

changing a relative clocking position of at least one of the at least three airfoil rows;

recalculating airflow across the at least three airfoil rows;

evaluating a second pressure variation at the at least one spanwise location of the diffuser;

determining whether the second pressure variation is less than the first pressure variation; and in the case that the second pressure variation is less than the first pressure variation, operating the turbomachine using the changed relative clocking position of the at least one airfoil row.

15. The method of claim 14, wherein the at least three airfoil rows includes:

a first airfoil row adjacent the diffuser, the first airfoil row being of a first type selected from a group consisting of: stationary vanes and rotating blades;

a second airfoil row adjacent the first airfoil row, the second airfoil row being of a second type different from the first type; and a third airfoil row of the first type adjacent the second airfoil row.

16. The method of claim 15, wherein changing the relative clocking position includes changing the clocking position of an airfoil row other than the first, second, or third airfoil rows.

17. The method of claim 14, wherein calculating the airflow includes using computational fluid dynamics equations.

18. The method of claim 17, wherein the computational fluid dynamics equations include Navier-Stokes solver equations.

* * * * *